US008594536B2

(12) United States Patent
Kuramoto et al.

(10) Patent No.: US 8,594,536 B2
(45) Date of Patent: Nov. 26, 2013

(54) DEVELOPING UNIT AND IMAGE-FORMING APPARATUS

(75) Inventors: Shinichi Kuramoto, Ebina (JP); Taichi Yamada, Minamiashigara (JP); Masahiro Uchida, Minamiashigara (JP); Mutsumi Kikuchi, Yokohama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 260 days.

(21) Appl. No.: 13/149,377

(22) Filed: May 31, 2011

(65) Prior Publication Data

US 2012/0099899 A1 Apr. 26, 2012

(30) Foreign Application Priority Data

Oct. 25, 2010 (JP) ..... 2010-239023

(51) Int. Cl.
*G03G 15/08* (2006.01)

(52) U.S. Cl.
USPC ..... 399/254

(58) Field of Classification Search
USPC ..... 399/254, 255
See application file for complete search history.

(56) References Cited

U.S. PATENT DOCUMENTS

| | | | | |
|---|---|---|---|---|
| 5,963,766 | A * | 10/1999 | Okuno et al. | 399/256 |
| 2007/0189810 | A1* | 8/2007 | Ohsawa | 399/254 |
| 2009/0010662 | A1* | 1/2009 | Naoi et al. | 399/44 |

FOREIGN PATENT DOCUMENTS

| | | | |
|---|---|---|---|
| JP | 07-310102 | A | 11/1995 |
| JP | 07-334101 | A | 12/1995 |
| JP | 2007-310098 | A | 11/2007 |

OTHER PUBLICATIONS

Translation of JP 2007334101 A, pub date: Dec. 27, 2007.*

* cited by examiner

*Primary Examiner* — Walter L Lindsay, Jr.
*Assistant Examiner* — Frederick Wenderoth
(74) *Attorney, Agent, or Firm* — Sughrue Mion, PLLC

(57) ABSTRACT

A developing unit includes: a developing roller; a first conveying member provided in a first container, having a first shaft and a spiral blade, that agitates and conveys developer; a second conveying member provided in a second container connected to the first container via a hole, having a second shaft and a spiral blade, that agitates and conveys the developer; and a supplying member having a third shaft and a paddle blade, that supplies the developer conveyed by the first or the second conveying member to a developing roller, wherein: at least one of the first and second shafts includes a first portion that faces the hole and a second portion that does not face the hole; and a diameter of the at least one of the first and second shafts in at least a part of the first portion is smaller than a diameter in the second portion.

6 Claims, 7 Drawing Sheets

DEVELOPING UNIT AND IMAGE-FORMING APPARATUS

CROSS-REFERENCE TO RELATED APPLICATIONS

This application is based on and claims priority under 35 U.S.C. 119 from Japanese Patent Application No. 2010-239023, which was filed on Oct. 25, 2010.

BACKGROUND

1. Technical Field

The present invention relates to a developing unit and image-forming apparatus.

2. Related Art

There is known an electrophotographic image-forming apparatus having a developing unit that includes: a housing containing a two-component developer composed of toner and carrier; a developing agitate member that receives the developer in the housing to carry it toward the photosensitive member; and a developer conveying member that supplies the agitated toner to a developing roller.

In the developing unit, when developer is not uniformly circulated in a housing, a density of toner adhered to a photosensitive member becomes inconsistent, or other problems arise. This results in formation of reduced-quality images by the apparatus. It is known that uniformity of circulation of the developer is prone to be reduced especially in an area near the end, in a longitudinal direction, of the developing unit in which area a direction of a developer flow is significantly changed.

SUMMARY

According to an aspect of the present invention, there is provided a developing unit including: a developing roller; a first conveying member provided in a first container, having a first shaft and a spiral blade formed on the first shaft, that agitates and conveys developer; a second conveying member provided in a second container connected to the first container via a hole, having a second shaft and a spiral blade formed on the second shaft, that agitates and conveys the developer; and a supplying member having a third shaft and a paddle blade formed on the third shaft, that supplies the developer conveyed by the first or the second conveying member to a developing roller, wherein: at least one of the first and second shafts includes a first portion that faces the hole and a second portion that does not face the hole; and a diameter of the at least one of the first and second shafts in at least a part of the first portion is smaller than a diameter in the second portion.

BRIEF DESCRIPTION OF THE DRAWINGS

Exemplary embodiments of the present invention will be described in detail based on the following figures, wherein.

DETAILED DESCRIPTION

Figure 1:
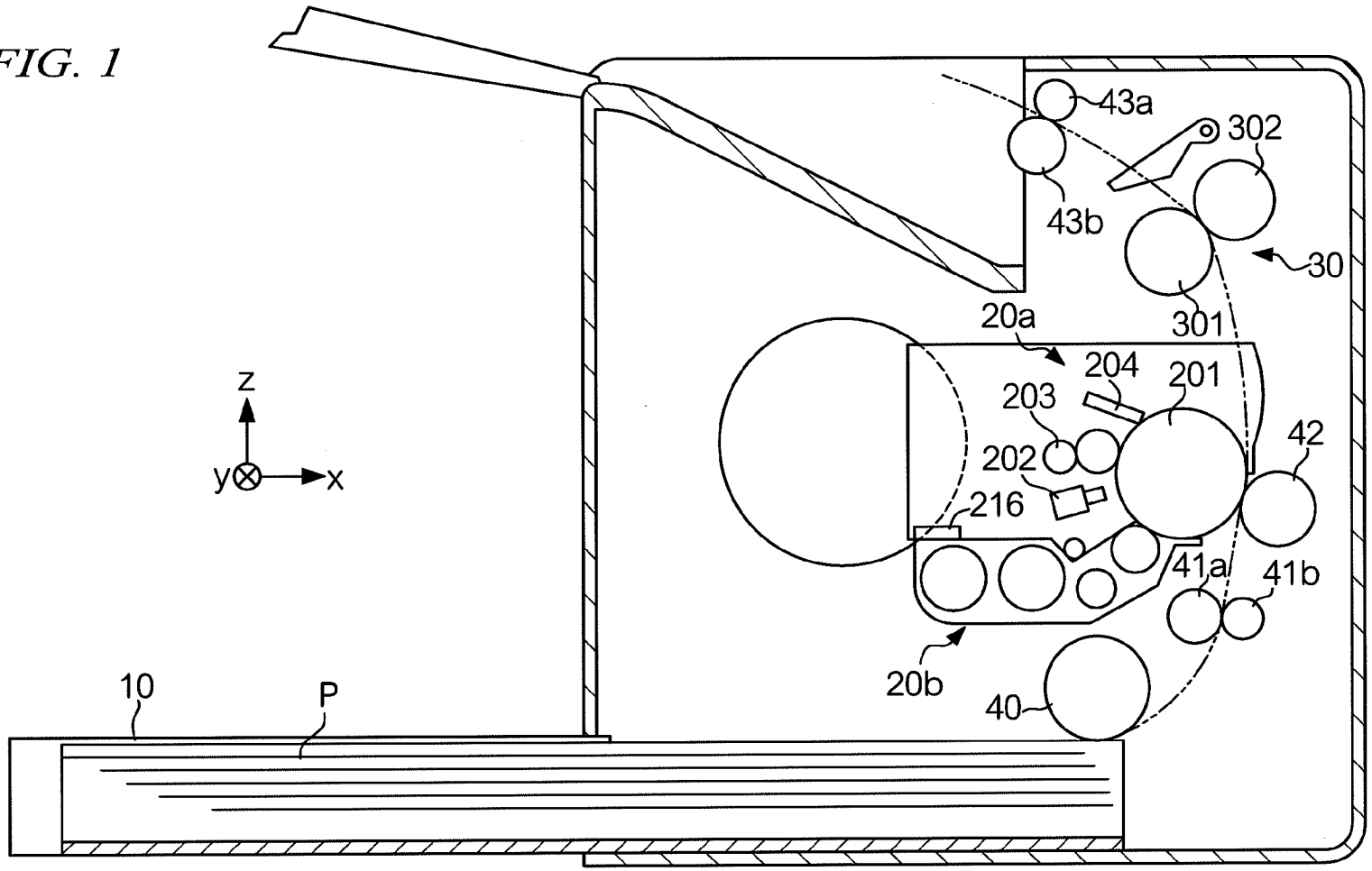
FIG. 1 is a schematic diagram of an internal structure of image forming apparatus 1.

FIG. 1 is a schematic diagram showing an internal structure of image forming apparatus 1. Image forming apparatus 1 essentially includes paper cassette 10, drum unit 20*a*, developing unit 20*b*, and fixing unit 30. The developer housed in image forming apparatus 1 is often referred to as a two-component developer, and includes a toner as a colorant particle, which is eventually adhered to a paper P and powder as a carrier, which enables the toner to become charged. Paper cassette 10 contains papers P, which are media on which images are formed. When an image forming process is initiated, paper P firstly undergoes adjustments of its position and timing by conveyor rollers 40, 41A, and 41B. Next, a latent image formed by a drum unit 20*a* is transferred to paper P by a transfer roller 42. Next, the latent image on paper P is fixed by a heat roller 301 and pressure roller 302. Finally, paper P is conveyed through conveyor rollers 43A and 43B and comes out of the apparatus. Drum unit 20*a* includes a photosensitive drum 201, charging unit 203, exposing unit 202, and toner-removing member 204. Charging unit 203 charges a photosensitive drum. Exposing unit 202 irradiates photosensitive drum 201 with a laser light generated based on image data to be formed. As a result, a latent image is formed on photosensitive drum 201. Toner removing member 204 removes a redundant developer adhered on photosensitive drum 201.

In the configuration described above, paddle 213 is an example of the developer supplier and drum unit 20*a* is an example of the image-forming unit, and transfer roller 42 is an example of the transfer unit.

Figure 2:
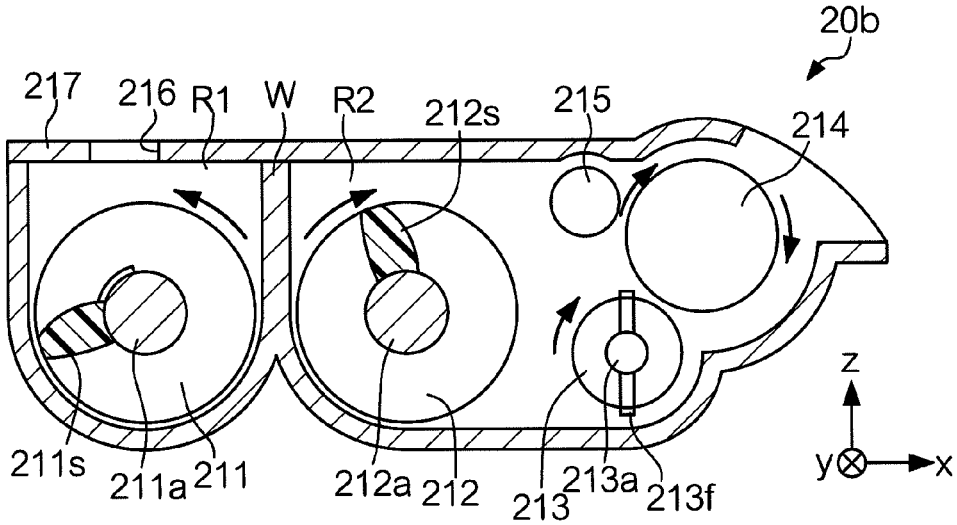
FIG. 2 shows a developing unit 20*b* as viewed in the same direction as FIG. 1.

FIG. 2 shows developing unit 20*b* viewed from the same direction as in FIG. 1. Developing unit 20*b* includes housing 217, first conveying member 211, second conveying member 212, paddle 213, developing roller 214, thickness restricting member 215, and toner inlet port 216. Housing 217, first conveying member 211, second conveying member 212, paddle 213, and developing roller 214*a* have shafts aligned parallel to Y axis, and are able to rotate around axes of the shafts, each of which is rotatably connected to housing 217 at both ends. Specifically, the members are aligned such that positions of the shafts are located in the following order: conveying member 211; second conveying member 212; paddle 213; thickness restricting member 215; and developing roller 214 as viewed from X− to X+ directions (i.e., from left to right in the figure). Gears (not shown in the figure) are equipped at an end of each of first conveying member 211, second conveying member 212, paddle 213, and developing roller 214, which ends protrude from housing 217, and convey driving force generated by a motor (not shown in the figure) to shafts. The gears are mechanically coupled with each other. Coupling of the gears defines a ratio between rotation speeds of the shafts of the above members 212, 213, 214 and 217. Differing sizes of the gears will realize differing ratios of rotation speeds. Supposing that an average rotation speed among the shafts of first conveying member 211, second conveying member 212, paddle 213, and developing roller 214 is 1, sizes of the gears can preferably be set such that rotation speeds of the shafts lie within a range of 0.8 to 1.2.

A wall W is provided between first conveying member 211 and second conveying member 212 along Y axis. Wall W serves to form first container R1 and second container R2 in developing unit 20*b*. Holes 220L and 220R connecting first container R1 and second container R2 are formed at ends (refer to FIG. 3) of wall W along Y axis. First conveying member 211 includes shaft 211*a* and spiral blade 211S formed on shaft 211*a*. Similarly, second conveying member 212 includes shaft 212*a* and spiral blade 2125 formed on shaft 212*a*. Paddle 213 includes shaft 213*a* and two paddle blades 213*f*. Developing roller 214 has a cylindrical member having a metal shaft (not shown in the figure), and a magnet roller (not shown in the figure) inside which multiple magnets are aligned around the shaft, and a body having a surface that the developer contacts. Thickness restricting member 215 is also a cylindrical member made of a magnetic substance. Outer diameters, (i.e., lengths perpendicular to the shafts) of first conveying member 211 and second conveying member 212 are the same. An outer diameter of Paddle 213 is smaller than that of second conveying member 212. An outer diameter of developing roller 214 is smaller than that of second conveying member 212 and larger than that of paddle 213.

Developing unit 20*b* is mounted on image forming apparatus 1 horizontally (i.e., in a plane perpendicular to Z axis). Specifically, the bottom (the lowest possible position of the developer) of housing 217 lies within a plane perpendicular to Z axis, This means that if second conveying member 212 does not rotate, the top (highest possible position) of the developer is substantially horizontal. As shown in the same figure, heights (position in Z axis) of the shafts of first conveying member 211, second conveying member 212, paddle 213, developing roller 214, thickness restricting member 215 are all different. Hereinafter, the bottom of housing 217 is taken as a reference height (zero height). The shafts 211*a* and 212*a* are mounted at the same height. The shaft of developing roller 214 is mounted in a position higher than that of the shafts 212*a* and 213*a*. The shaft of thickness restricting member 215 is mounted in a position higher than that of developing roller 214. Shaft 213*a* is mounted in a position lower than shaft 212*a*.

In the configuration described above, the amount of the developer contained in housing 217 is controlled so that the top of the developer is kept higher than the shaft 213*a* and lower than a highest possible position of paddle 213, i.e., a height of shaft 213*a* added by the length of blade 213*f* with reference to the bottom of second container R2. It is noted that the developer is filled within the range described above in its initial condition. The amount of the developer in housing 217 decreases as image-forming processes are performed. More specifically, the amount of the carrier in developing unit 20*b* is substantially unchanged, while toner is consumed each time image-forming processes are performed. Accordingly, in image-forming apparatus 1 toner is added from toner inlet port 216 to replenish consumed toner, so as to keep the top of the developer within the above-described range. More specifically, a sensor for sensing a magnetic permeability in developing unit 20*b* is provided inside first container R1, so as to calculate a concentration of the developer in first container R1. A height of the developer in second container R2 is calculated using data output by the sensor. For example, filling factors of the developer and pieces of information on rotation speeds of first conveying member 211 and second conveying member 212 are stored in advance in association with each other, in a table. Timing of injection of toner into housing 217 and an amount of injected toner are determined by reference to the table. Alternatively, it is possible to measure a height of the developer by a touch sensor provided inside second container R2, instead of calculating it from a filling factor of the developer.

Figure 3:
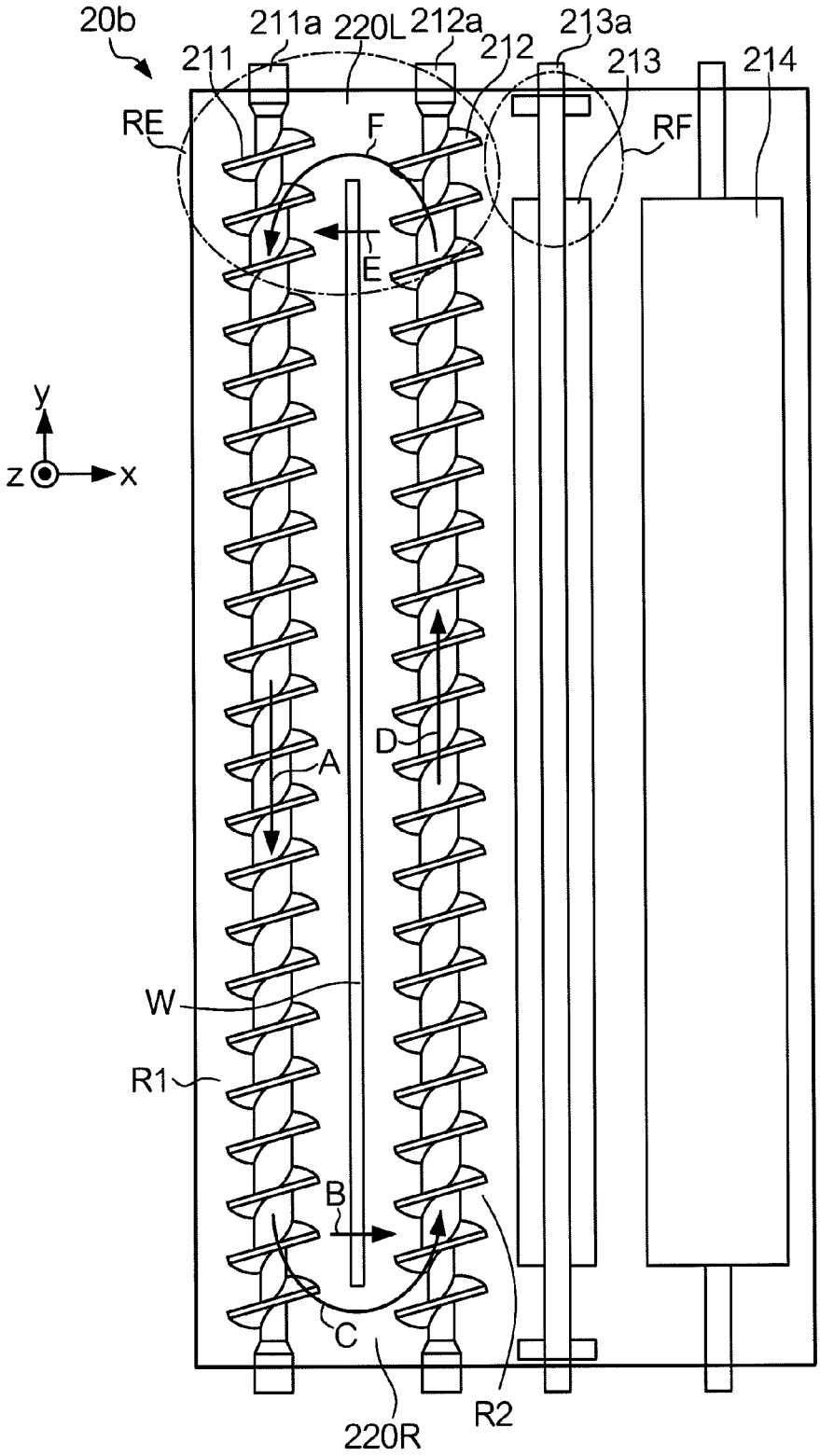
FIG. 3 shows a developing unit 20*b* as viewed in a Z direction shown in FIG. 2.

FIG. 3 shows developing unit 20*b* described in FIG. 2 in an upper view, i.e., as viewed from an end of Z axis. It is noted that thickness-restricting member 215 is omitted in the figure for convenience of explanation. The toner inlet port 216 (not shown in the figure) is provided on housing 217 near hole 220L, through which toner is supplied to container R1 from a toner cartridge (not shown in the figure) as required. Supplied toner is agitated with carrier and charged by first conveying member 211 rotating in first container R1. At the same time, the toner is conveyed in a direction shown by arrow A in first container R1 by first conveying member 211. Some of the toner arriving at the other end of Y axis in first container R1 flows into second container R2 via hole 220R, as shown by arrows B and C. Developer in second container R2 is conveyed in a direction shown by arrow D under influence of rotation of second conveying member 212. During conveyance with second conveying member 212, a portion of the toner moves toward developing roller 214 under influence of rotation of paddle 213 in a direction shown by an arrow as depicted in the figure. The toner moves along the surface of developing roller 214, under influence of rotational motion of developing roller 214. Toner included in the developer moving along the surface of developing roller 214 is adhered to photosensitive drum 201 by an electrostatic force. The amount of developer held on developing roller 214 is restricted by thickness restricting member 215. Toner failing to adhere to photosensitive drum 201 moves downward along the surface of developing roller 214 and returns to paddle 213, where the toner is agitated. Some toner agitated by paddle 213 is conveyed by second conveying member 212 in a direction shown by arrow D. A portion of developer arrived at an end of second conveying member 212 in Y axis flows into first container R1 via hole 220L, as shown in arrows E and F. Thereby, the developer circulates in developing unit 20*b*, while being supplied to drum unit 20*a*.

Figure 4:
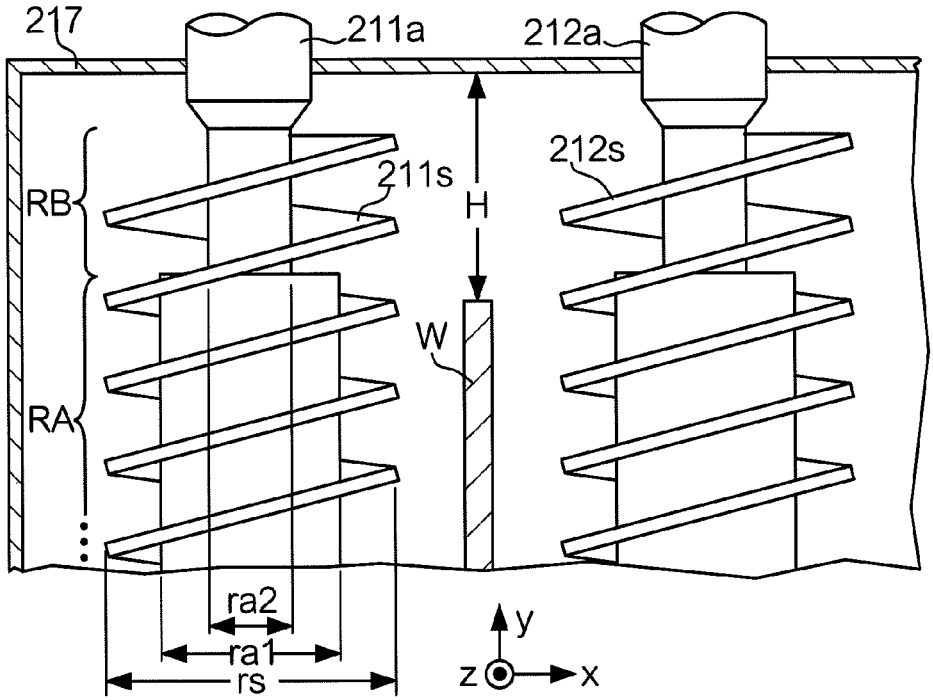
FIG. 4 is an enlarged view of an area RE shown in FIG. 3.

Developing unit 20*b* has a symmetric structure in Y axis center with regard to its center. Thus, the description will be directed to a structure near one end of developing unit 20*b*, which is shown as an area RE in the figure at which hole 220L is provided, hereinafter. FIG. 4 is an enlarged view of first conveying member 211 and second conveying member 212 shown in FIG. 3 near area RE. First conveying member 211 includes a center portion RA and end portion RB. End portion RB is defined as a region of shaft 211*a* starting from an edge and ending with a position apart from a side wall of housing 217 by a distance H. An end of end portion RB is in the same position along the Y axis as the end of wall W extending toward the side wall of housing 217 from its center (not shown in the figure). Diameter of shaft 211*a* is ra1 in portion RA and is ra2 (<ra1) in portion RB. In other words, shaft 211*a* is designed such that the diameter is smaller in portion RB, which faces hole 220L, than in portion RA, which does not face hole 220L. A structure of second conveying member 212 is the same as that of first conveying member 211 except in that they rotate in opposite directions, as shown in the same figure. Therefore, detailed explanation thereof is omitted.

Figure 5A:
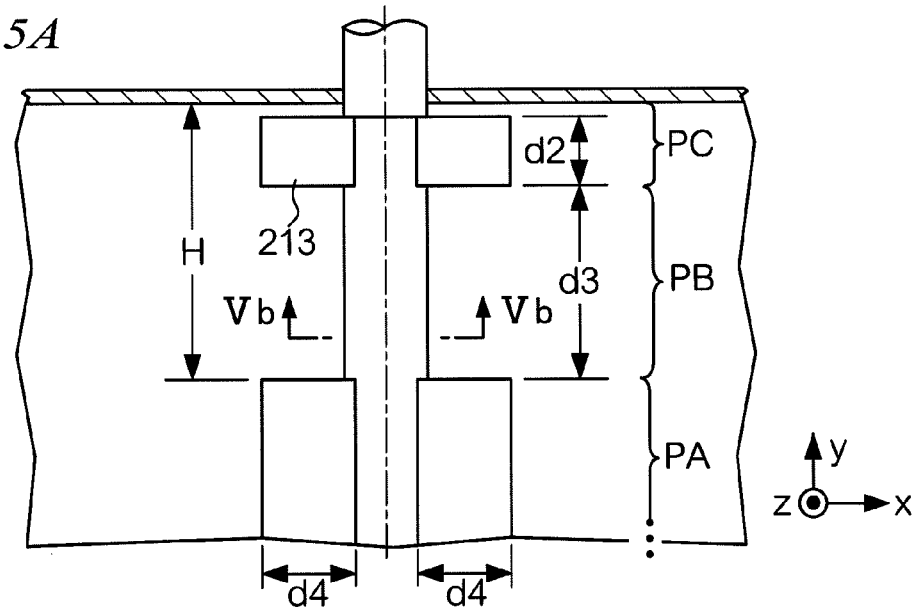
FIG. 5A is an enlarged view of an area RF shown in FIG. 3.
Figure 5B:
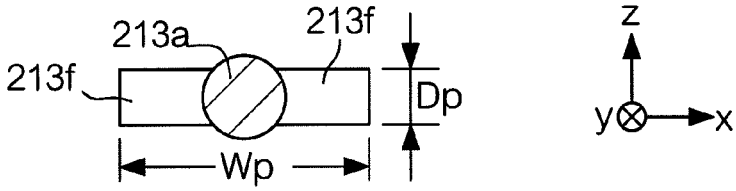
FIG. 5B is a cross-sectional view of FIG. 5A.

FIG. 5 is an enlarged view of paddle 213 in an area RF shown in FIG. 3. More specifically, FIG. 5A shows paddle 213 as viewed from the top and FIG. 5B is a cross-sectional view of FIG. 5A with regard to a Vb-Vb plane. Paddle 213 includes a center area PA, first end portion PB, and second end portion PC. As shown in the figure, second end portion PC is defined as a region in which a distance from the side wall of housing 217 is less than d2. First end portion PB is defined as a region in which the distance is more than d2 and less than d3. Center area PA is defined as a region in which the distance is more than d3. Blades 213*f* with a thickness Dp are formed on shaft 213*a*, such that a height of shaft 213*a*, i.e., a length from a rotational axis of shaft 213*a* to the outer edge of paddle 213 in a direction perpendicular to the axis, is d4 (=Wp/2) in center area PA. In paddle end portion PB, no blade is formed on shaft 213*a*. In second end portion PC, similarly to center area PA, two blades 213*f* are formed on shaft 213*a*, each having a height d4. In other words, no blade 213*f* is formed in first end portion PB, which is a part of regions PB and PC facing hole 220L across second conveying member 212, whereas in center area PA, which does not face hole 220L, blades 213*f* are formed. In other words, an outer diameter of paddle 213 is not uniform with regard to the direction of shaft 213*a*, since a part of the outer diameter near the end is small. It is possible to produce paddle 213 by providing two plates as raw material of blades 213*f*, notching the plates corresponding to region RB, and connecting the notched plates to shaft 213*a*. Alternatively, it is possible to prepare uncut plates, connect them to shaft 213*a* and cut out the plates partially to shape blades 213*f*.

Due to the positional relationships among first conveying member 211, second conveying member 212, paddle 213, and hole 220L and slimmed shafts described above, a larger space is provided in a ZX plane in developing unit 20*b* for the developer to pass through, which enables the developer to move easily along X axis. In center portion RA facing wall W on which hole 220L is not formed, diameters of shafts 211*a* and 212*a*, i.e., distances to wall W, are uniform. Thus, there is no force added by which a flow of the developer in Y axis is caused to change to X direction, which will prevent a smooth flow in Y direction. Thus, in the above configuration there is no unfavorable effect occurring in uniformity of circulation of developer in an area far from the sidewall of housing 217. Improvement in a flow of the developer in area RE (specifically, a flow from second container R2 to first container R1 in hole 220L and a flow from first container R1 to second container R2 in hole 220R) results in an improvement in uniformity of circulation of the developer in developing unit 20*b*. Additionally, since in end areas RE no blade is formed on paddle 213, there is a large space for the developer to pass through as compared to the center region, the developer is not likely to gather in end areas RE. Further, a lower concentration of the developer at end areas RE results in a lower chance of an excessive amount of the developer being supplied from end areas RE to a respective edge of developing roller 214. Stabilization of an amount of the toner on any position on developing roller 214, eventually improves quality of an image formed on Paper P. Still further, since rotation of blades 213*f* in second end portion PC generates force to cause the developer to move in X+ direction, a suitable amount of the developer is constantly supplied to developing roller 214 at its ends. Accordingly, a reduction in quality of image due to a shortage of supplied developer at the ends of developing roller 214 is not likely to occur. As for the developer moving from developing roller 214 to paddle 213 in X direction under influence of rotation of developing roller 214, it can easily pass though a space near first end portion PB, similarly to the reasoning for the flow in X+ direction. In other words, the developer returning from developing roller 214 does not easily gather in an area near area RE and can easily be agitated and conveyed by second conveying member 212. By the foregoing reasoning, an improvement in uniformity of circulation of the developer improves in developing unit 20*b*, resulting in a consistent concentration of the developer, and eventually in improvement in quality of a formed image.

Configurations of conveying member 211, second conveying member 212, and paddle 213 are not limited to the foregoing description. For example, a ratio of diameters of a shaft in an end portion and center portion may be determined based on the total amount of developer, volumes of first container R1, first container R1, length of wall W, shape of housing 217 and holes 220L and 220R or other factors. A ratio of heights of a blade formed in an end portion and center portion may also be determined thus. As for a positional relationship between hole 220L, end portion RB, first end portion PB (PC), it is not necessary to design shafts of conveying member 211 and second conveying member 212 such that a diameter of a shaft in all areas facing hole 220L (220R) is smaller than a diameter in the remaining portion. Similarly, it is not necessary to design blade 213*f* such that a height of blade 213*f* in all areas facing hole 220L (220R) is smaller than a height of blades 213*f* formed on the remaining portion. In other words, it is not necessary that a position and length of the above characteristic portions of first conveying member 211 and second conveying member 212 exactly correspond to a position and size of hole 220L (220R). Similarly, it is not necessary that a position and size of hole 220L (220R) are in complete correspondence with a position and length of the characteristic portion of paddle 213.

Examples of other configurations for conveying members 211 and 212 and paddle 213 will now be described. It is noted that it is possible to adapt any combination of exemplified conveying members 211 and 212 and paddle 213 described below to configure developing unit 20*b*. Simply stated, in a developing unit that includes: a developing roller; first conveying member (211) provided in the first container (R1), having the first shaft (211*a*) and the first spiral blade (211S) formed on the first shaft, that agitates and convey developer; second conveying member (212) provided in the second container (R2) connected to the first container via a hole (220L, 220R), having the second shaft (212*a*) and spiral blades (212S) formed on the second shaft, that agitates and conveys the developer; supplying member (213) having the third shaft and a blade (213*f*) formed on the third shaft, that supplies the developer conveyed by the conveying member to a developing roller (214), either condition (A) or (B) described below is fulfilled to improve uniformity of circulation of the developer.

(A) At least one of the first and second shafts includes the first portion that faces the hole and the second portion that does not face the hole, and a diameter of at least one of the first and second shafts in at least a part of the first portion is smaller than in a diameter in the second portion.

(B) The third shaft includes the third portion that faces the hole across the second conveying member and the fourth portion that does not face the hole, and a height of the blade (i.e., a length of the blade in a direction perpendicular to an axis of the third shaft) in at least a part of the third portion is smaller than in the fourth portion.

(1) Examples of Conveying Members

Figure 6:
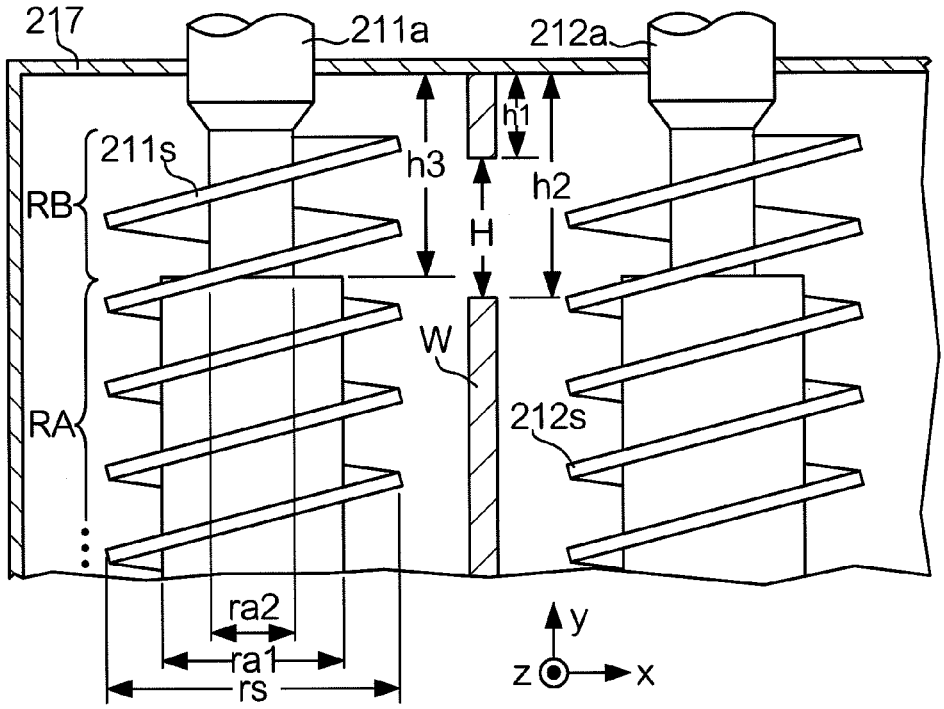
FIG. 6 shows another example of a first conveying member 211 and second conveying member 212.

FIG. 6 shows another example of the conveying members described above. As shown in the figure, there is a difference in a relationship between a position of a boundary of end portion RB and center portion PA in first conveying member 211 and second conveying member 212 and in a position of hole 220L as compared to the configuration shown in FIG. 4. In this configuration, wall W lies within a distance h1 from the side wall of housing 217 and a distance h2 from the side wall of housing 217 toward a center in Y direction, forming a hole 220L having a length H=h2−h1 in Y axis. On the other hand, end portion RB extends from the side wall of housing 217 to a distance h3 where h3≠H and h3≠h2. In other words, one of the edges (the lower one in the figure) of hole 220L in Y axis is located in the side of the side wall of housing 217 (the upper one in the figure) with regard to a boundary between end portions RB and RA. It is apparent in the figure that in this configuration a part of the slimmed portions of shafts 211*a* and 212*a* face hole 220L and all the regions of the shafts facing wall W are non-slimmed portions. This means that condition (A) described above is fulfilled. Since there is an additional space generated for the developer near the side wall of housing 217 to pass through, the developer in end portion RB can easily move in X direction. On the other hand, since a distance between the shafts and wall W is constant in the region facing wall W, a movement of the developer in X direction is restricted in the region. As a result, circularity of the developer in the developing unit 20*b* improves.

Figure 7:
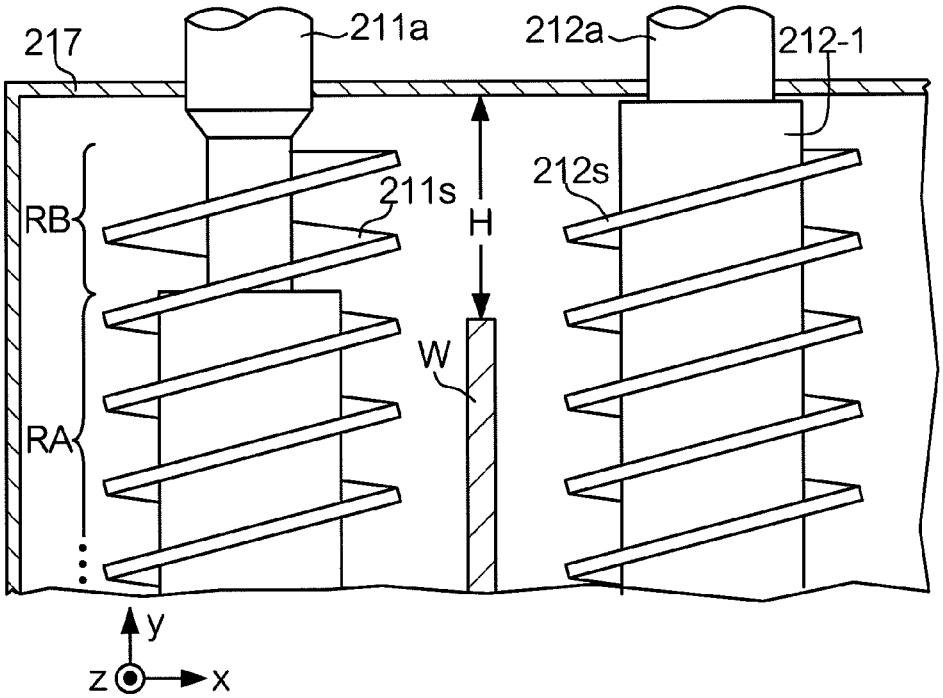
FIG. 7 shows yet another example of first conveying member 211 and second conveying member 212.
Figure 8:
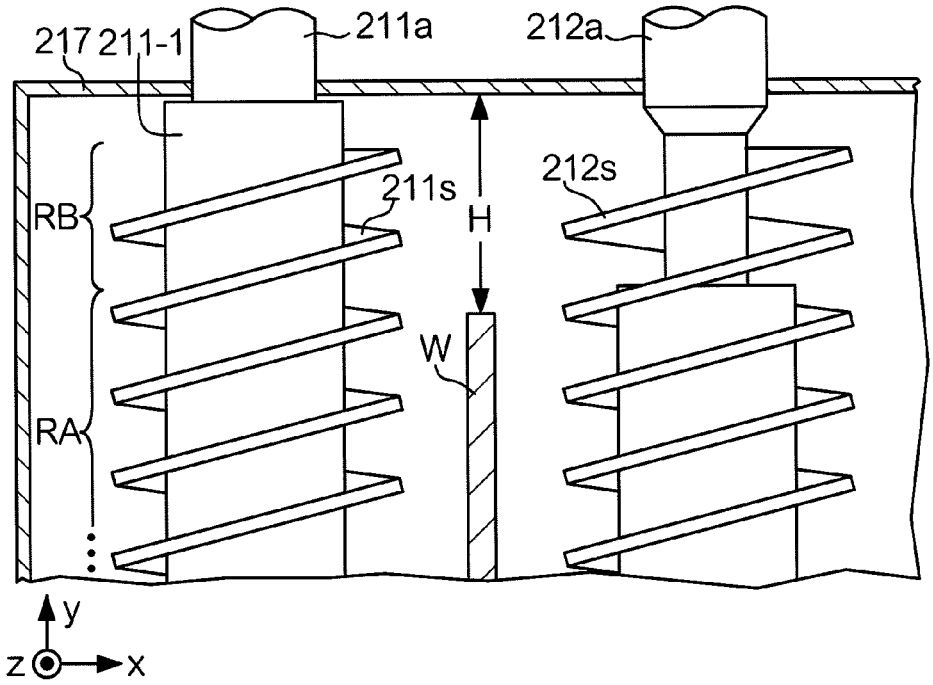
FIG. 8 shows yet another example of first conveying member 211 and second conveying member 212.

FIG. 7 shows yet another example of a pair of conveying members and wall W. In this configuration, there is no wall provided between hole 220L and the side wall of housing 217. Additionally, first conveying member 211 and second conveying member 212 have different structures. Specifically, second conveying member 212-1 is employed in place of first conveying member 212. Second conveying member 212-1 has a shaft 212*a* having a uniform diameter, which means that a diameter of the shaft in end portion RB facing hole 220L is the same as that in center portion RA. Alternatively, it is possible to employ first conveying member 211-1 in place of second conveying member 211, as shown in FIG. 8. As shown in FIGS. 7 and 8, it is possible to adapt different structures in end portion RB for first conveying member 211 and second conveying member 212. Even in a case where only one of the conveying members has the slimmed shaft described above, accumulation of the developer in end portion RB is inhibited as compared to a case where both shafts have uniform diameters. As a result, circularity of the developer in the developing unit 21*b* improves.

Figure 9:
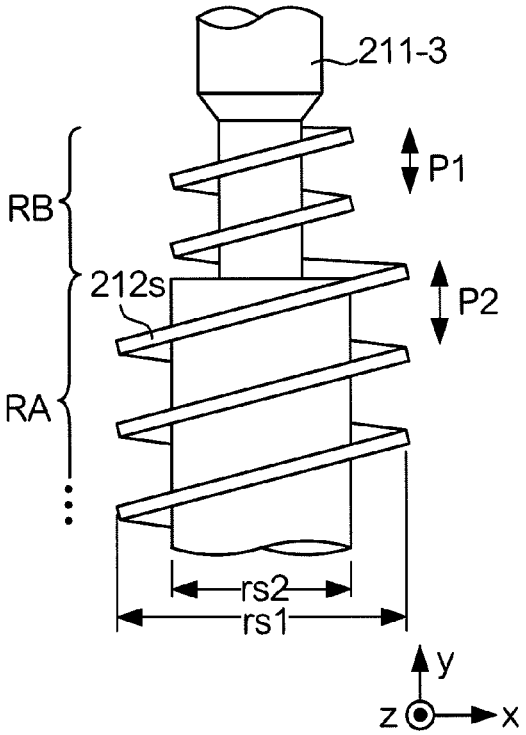
FIG. 9 shows yet another example of first conveying member 211 or second conveying member 212.

FIG. 9 shows yet another example of the conveying members. The exemplified configuration of conveying shaft 211-3 has the same features as those of first conveying member 211 and second conveying member 212 in which a shaft includes thick portion RA and thin portion RB. This exemplified configuration has an additional feature in which a height of spiral blade 212S formed in end portion RB is lower than that formed in center portion RA. In other words, the outer diameter of first conveying member 211-2 (second conveying member 212-2) is rs1 in center portion RA and is rs2 (<rs1) in end portion RB. A slimmed shaft and lower height blade realized near a region facing hole 220L results in reduced force of conveying the developer in Y direction in area RE. Therefore, a flow of the developer in X direction improves. As a result, uniformity of circulation of the developer near hole 220L further improves. Additionally, it is possible to differ a pitch P1 of spiral blade 212S in end portion RB compared to a pitch P2 in center portion RA, to further reduce force for moving the developer in Y direction.

Figure 10:
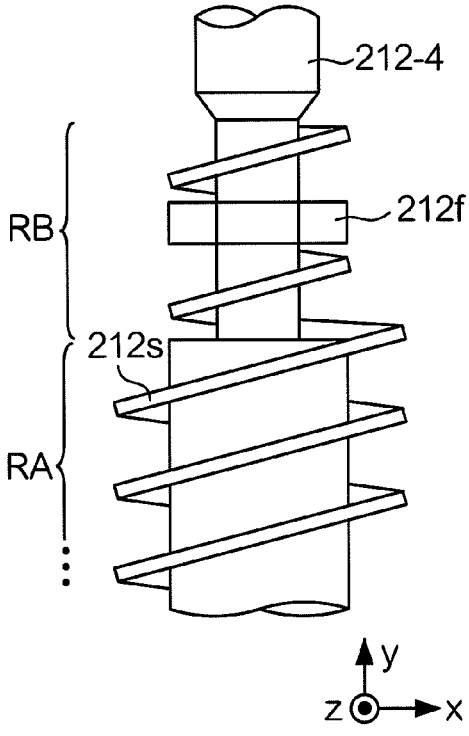
FIG. 10 shows yet another example of the second conveying member 212.

FIG. 10 shows another example of second conveying member 212. Second conveying member 212-4 includes two rectangular plate blades 212*f*, each having a side parallel to Y axis and formed on shaft 212*a* in end portion RB, in addition to spiral blade 212S. Rotating blades 212*f* cause the developer to be conveyed in X direction, thus concentration of the developer in area RE is reduced.

(2) Examples of the Paddle

Figure 11A:
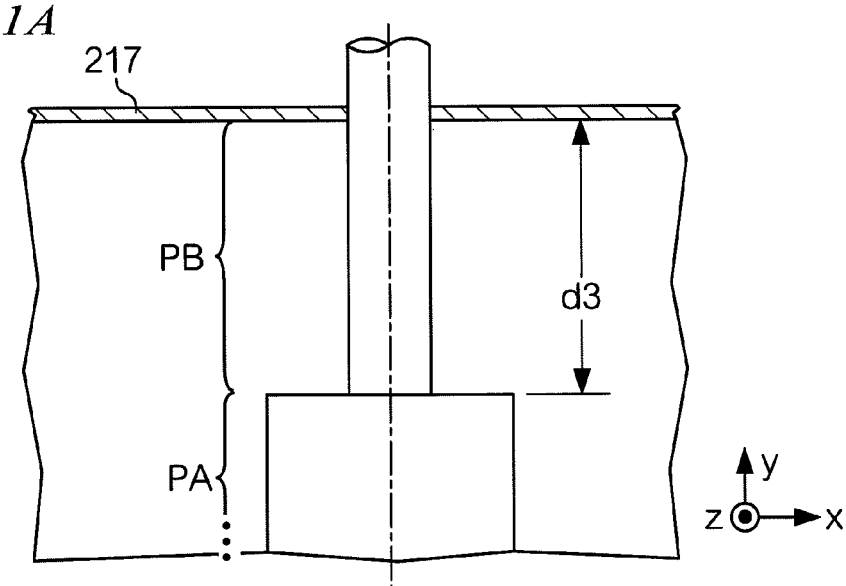
FIG. 11A shows another example of paddle 213.
Figure 11B:
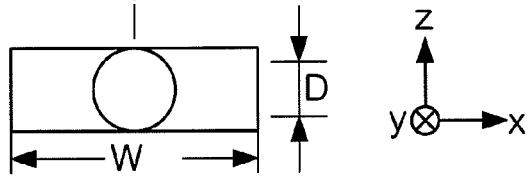
FIG. 11B is a cross-sectional view of FIG. 11A.

FIG. 11 shows another example of paddle 213. The exemplified paddle 213-1 includes center portion PA and first end portion PB, but no second end portion PC. Although paddle 213-1 effects weaker driving force to convey the developer residing in the nearest end portion to housing 217 toward developing roller 214 than with paddle 213, paddle 213-1 has an advantage of preventing the developer from being supplied to end region of developer roller 214 more than required, especially when a concentration of the developer in the developing unit is relatively high. It is possible to determine a length, height, and position of paddle blades formed on shaft 213*a* independently of a position of hole 220L. Specifically, either d3>h2 or d3<h2 is acceptable. Similarly, in FIG. 5, either d2>h1 or d2<h1 is acceptable. Simply stated, positions and lengths of end portions PB and PC are determined relative to a position and length of hole 220L in Y axis, as described above.

Figure 12A:
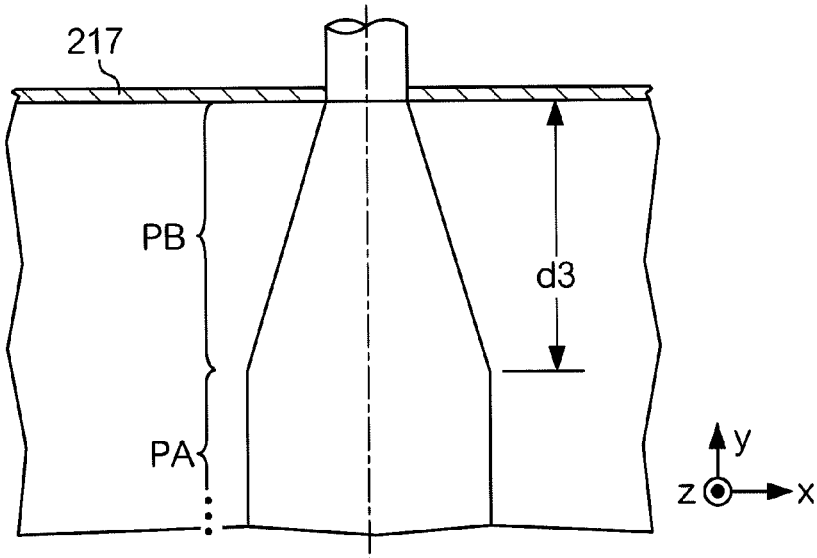
FIG. 12A shows yet another example of paddle 213.
Figure 12B:
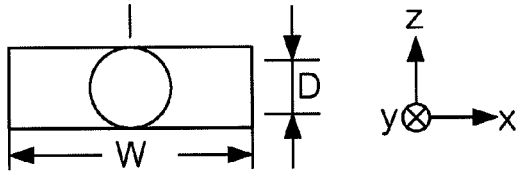
FIG. 12B is a cross-sectional view of FIG. 12A.

FIG. 12 shows yet another example of paddle 213. Paddle 213-2 has a shape in which second end portion PC is omitted, and blades of a tapered shape are provided in first end portion PB. In other words, in first end portion PB, a trajectory of rotating outer diameter paddle 213-2 is conical.

Figure 13A:
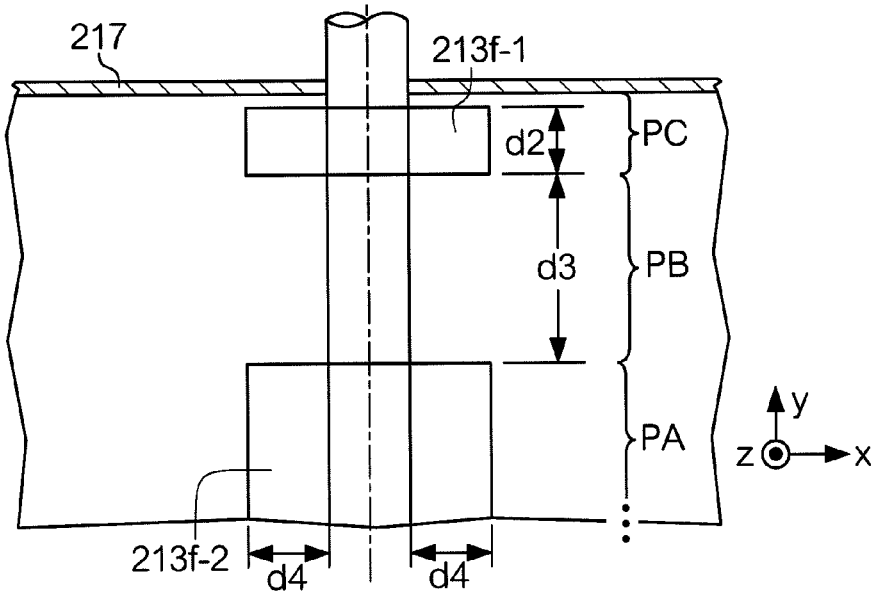
FIG. 13A shows yet another example of paddle 213.
Figure 13B:
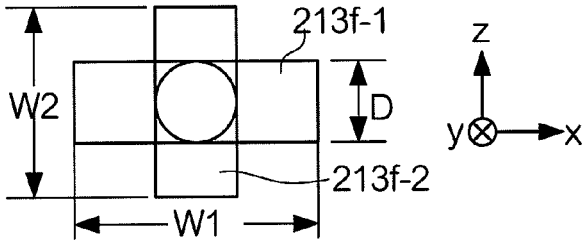
FIG. 13B is a cross-sectional view of FIG. 13A.

FIG. 13 shows yet another example of paddle 213. As shown in the figure, four blades are employed in paddle 213-3. Specifically, in both center portion PA and first end portion PB, a pair of blades 213*f*-1 each having a height ½*W1 are formed on a shaft in opposing directions (i.e., in 180 degrees) to each other within a plane perpendicular to Y axis, and a pair of blades 213*f*-2 having a height W2 are formed on the shaft in opposing directions to each other within a plane tilted with regard to the plane of the blades 213*f*-1 by 90 degrees. Since four blades hold more developer between blades 213*f*-1 and 213*f*-2 to be conveyed in response to rotation of the shaft than that held by two blades, the amount of developer supplied to developing roller 214 per rotation (by 360 degrees) increases. In addition, it is possible to determine a height of a pair of blades different from a height of the other pair of blades, so as to prevent decrease in uniformity of circulation or uniformity of toner concentration on developing roller due to an excessive amount of developer held between blades. It is possible to form three, five or more blades 213*f* on shaft 213*a*. For example, when three blades 213*f* are employed, it is preferable to form the blades on shaft 213*a* with spacing between each other by 120 degrees as viewed in along Y axis. Additionally, one of the three blades may have a lower height. It should be noted that a shape of a blade is not limited to a planar shape. The blade may have a curved surface.

In the exemplary embodiment, a pair of drum units 20*a* and developing unit 20*b* are employed in image forming apparatus 1 to form an image in a single color (black), it is possible to employ multiple pairs of drum units 20*a* and developing units 20*b* corresponding to each color. In this case, structures of first conveying member 211, second conveying member 212, and paddle 213 and positional relationships thereof with regard to holes 220L and 220R are the same in each developing unit.

Holes 220L and 220R can generally be construed as a space where wall W does not exist, including a hole formed in wall W as is literally meant. Simply stated, holes 220L and 220R are spaces that enable the developer to move between a first container R1 and second container R2.

The foregoing description of the embodiments of the present invention is provided for the purposes of illustration and description. It is not intended to be exhaustive or to limit the invention to the precise forms disclosed. Obviously, many modifications and variations will be apparent to practitioners skilled in the art. The embodiments were chosen and described to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing unit comprising:

a developing roller;

a first conveying member provided in a first container having a wall, having a first shaft and a first spiral blade formed on the first shaft, that agitates and conveys developer;

a second conveying member provided in a second container having the wall, the second container connected to the first container via at least one hole in an end of the wall, the second conveying member having a second shaft and a second spiral blade formed on the second shaft, that agitates and conveys the developer; and a supplying member having a third shaft and a paddle blade formed on the third shaft, that supplies the developer conveyed by the first or the second conveying member to the developing roller, wherein:

the third shaft includes a third portion and a fourth portion, the third portion facing the at least one hole in the end of the wall across the second conveying member, and the fourth portion not facing the at least one hole; and a height of the paddle blade, from the third shaft, formed on at least a part of the third portion of the third shaft is smaller than a height of the paddle blade, from the third shaft, formed on the fourth portion of the third shaft.

2. An image forming apparatus comprising:

a developing roller;

a first conveying member provided in a first container having a wall, having a first shaft and a first spiral blade formed on the first shaft, that agitates and conveys developer;

a second conveying member provided in a second container having the wall, the second container connected to the first container via at least one hole in an end of the wall, the second conveying member having a second shaft and a second spiral blade formed on the second shaft, that agitates and conveys the developer; and a supplying member having a third shaft and a paddle blade formed on the third shaft, that supplies the developer conveyed by the first or the second conveying member to the developing roller;

a photosensitve member;

an exposing unit;

a charging unit;

an image-forming unit that develops an image based on a latent image formed on the photosensitive roll using the developer supplied by the developing roller;

a transfer unit that transfers the developed image onto a recording medium; and a fixing unit that fixes the transferred image, wherein:

the third shaft includes a third portion and a fourth portion, the third portion facing the at least one hole in the end of the wall across the second conveying member, and the fourth portion not facing the at least one hole; and a height of the paddle blade, from the third shaft, formed on at least a part of the third portion of the third shaft is smaller than a height of the paddle blade, from the third shaft, formed on the fourth portion of the third shaft.

3. The developing unit of claim 1, wherein the third portion of the third shaft comprises a first end portion and a second end portion, wherein a height of the paddle blade, from the third shaft, formed on the first end portion is smaller than the height of the paddle blade, from the third shaft, formed on the fourth portion, and a height of the paddle blade, from the third shaft, formed on the second end portion is substantially the same as the height of the paddle blade, from the third shaft, formed on the fourth portion.

4. The developing unit according to claim 3, wherein:

the paddle blade formed on at least the fourth portion of the third shaft is rectangular and has a side that continuously extends parallel to a longitudinal side of the fourth portion of the third shaft; and the paddle blade formed on the third portion has a recess in the first end portion.

5. The image forming apparatus of claim 2, wherein the third portion of the third shaft comprises a first end portion and a second end portion, wherein a height of the paddle blade, from the third shaft, formed on the first end portion is smaller than the height of the paddle blade, from the third shaft, formed on the fourth portion, and a height of the paddle blade, from the third shaft, formed on the second end portion is substantially the same as the height of the paddle blade, from the third shaft, formed on the fourth portion.

6. The developing unit according to claim 5, wherein:

the paddle blade formed on at least the fourth portion of the third shaft is rectangular and has a side that continuously extends parallel to a longitudinal side of the fourth portion of the third shaft; and the paddle blade formed on the third portion of the third shaft has a recess in the first end portion.

* * * * *